US008495842B2

(12) United States Patent
Vafaee

(10) Patent No.: US 8,495,842 B2
(45) Date of Patent: Jul. 30, 2013

(54) FLUSH JAMB

(76) Inventor: Farhad Vafaee, Los Angeles, CA (US)

( * ) Notice: Subject to any disclaimer, the term of this patent is extended or adjusted under 35 U.S.C. 154(b) by 56 days.

(21) Appl. No.: 12/787,133

(22) Filed: May 25, 2010

(65) Prior Publication Data

US 2011/0289871 A1 Dec. 1, 2011

(51) Int. Cl.
*E06B 1/04* (2006.01)

(52) U.S. Cl.
USPC ..... 52/210; 52/62; 52/211; 52/656.4

(58) Field of Classification Search
USPC ..... 52/58, 62, 210, 211, 204.1, 287.1, 52/254, 656.4, 656.5, 716.8, 717.01, 717.05, 52/846, 716.1, 716.3, 718.03, 718.05, 717.06, 52/255, 631
See application file for complete search history.

(56) References Cited

U.S. PATENT DOCUMENTS

| | | | | |
|---|---|---|---|---|
| 4,034,528 | A | 7/1977 | Sanders et al. | |
| 4,669,238 | A | 6/1987 | Kellis et al. | |
| 4,704,837 | A * | 11/1987 | Menchetti et al. | 52/631 |
| 4,782,638 | A | 11/1988 | Hovind | |
| 5,136,823 | A | 8/1992 | Pellegrino | |
| 5,475,953 | A * | 12/1995 | Greenfield | 52/179 |
| 5,729,946 | A | 3/1998 | Beck | |
| 5,956,914 | A | 9/1999 | Williamson | |
| 6,000,185 | A | 12/1999 | Beck et al. | |
| 6,874,290 | B1 | 4/2005 | Bokan | |
| 7,204,062 | B2 | 4/2007 | Fairbanks et al. | |
| 7,516,587 | B2 | 4/2009 | Barlow | |
| 7,600,356 | B2 | 10/2009 | Benjamin et al. | |
| 2002/0043037 | A1 | 4/2002 | Dorsey et al. | |
| 2009/0241447 | A1 | 10/2009 | Vollan | |

* cited by examiner

*Primary Examiner* — William Gilbert
*Assistant Examiner* — Gisele Ford
(74) *Attorney, Agent, or Firm* — Norton R. Townsley; Belasco Jacobs & Townsley, LLP

(57) ABSTRACT

A door jamb which is flush with the wallboard. Also a door jamb which provides a pocket into which wallboard fits. The preferred embodiment of this invention comprises a central web having a first surface a second surface, a first side and a second side, with a first right triangular section at the first side and a second right triangular section at the second side. The adjacent leg of the first right triangular section is in line with the second surface and the opposite leg of the first right triangular section projects away from the first surface. Further the adjacent leg of the second right triangular section is in line with the first surface and the opposite leg of the second right triangular section projects away from the second surface.

32 Claims, 11 Drawing Sheets

Figure 2D
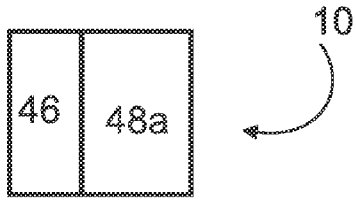
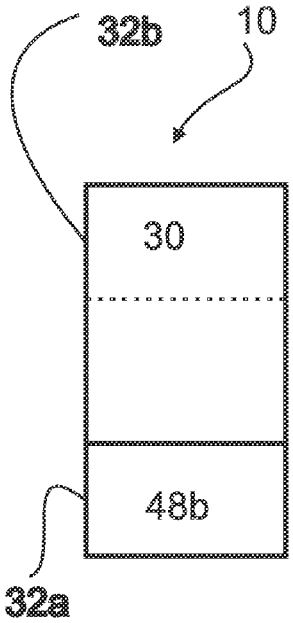
Figure 2C
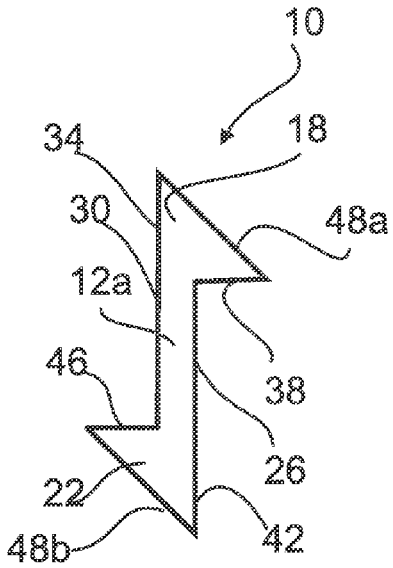
Figure 2
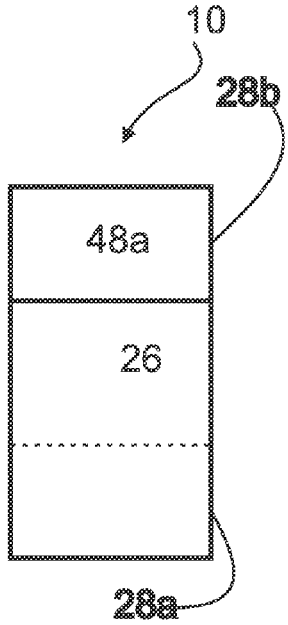
Figure 2A
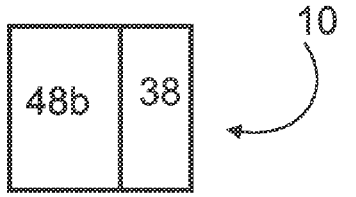
Figure 2B Figure 7D
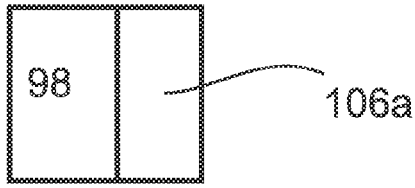
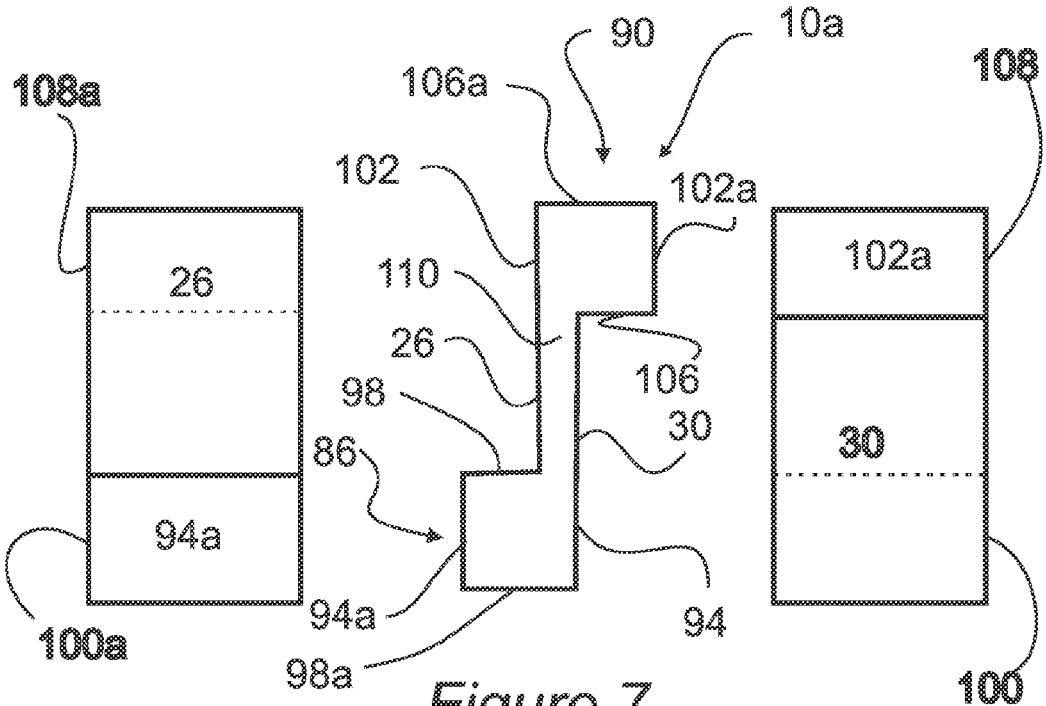
Figure 7
Figure 7C
Figure 7A
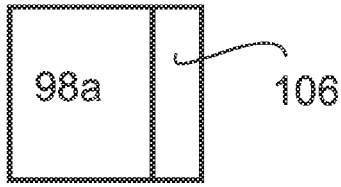
Figure 7B Figure 9D
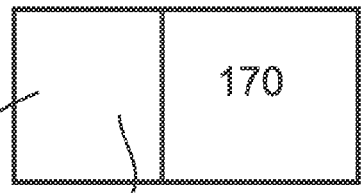
Figure 9A
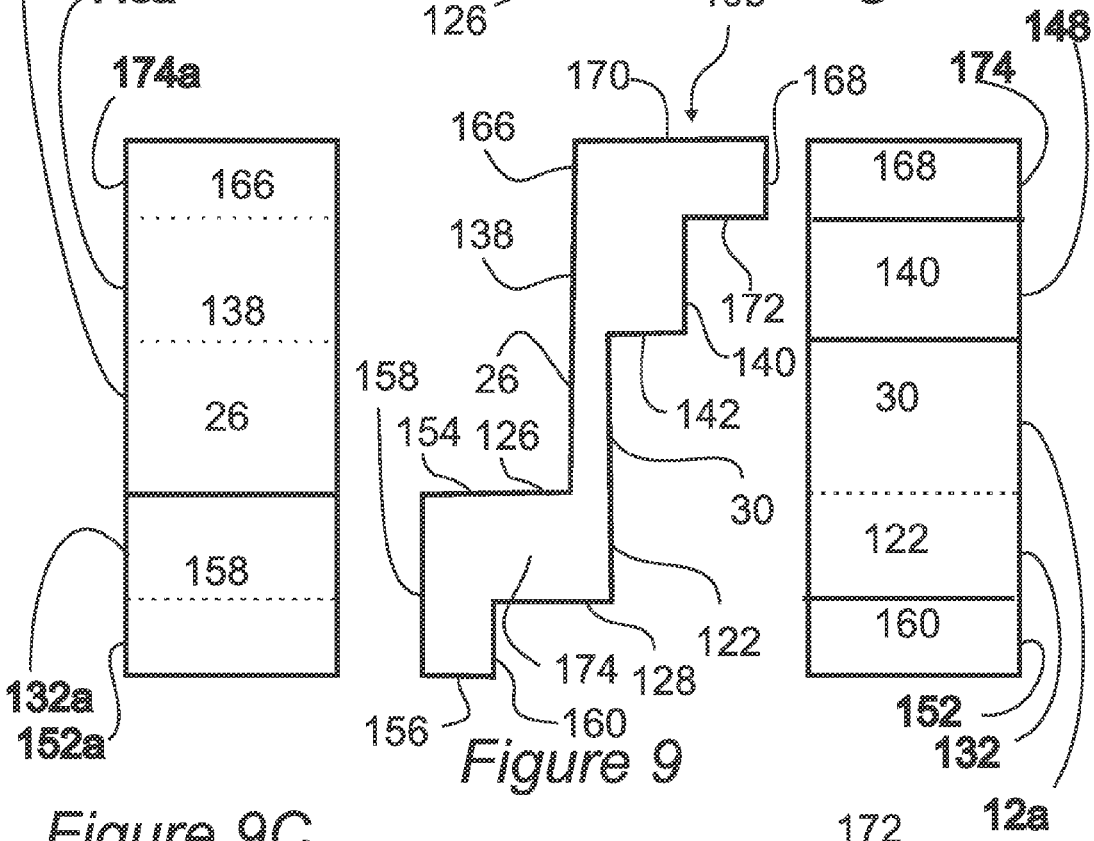
Figure 9
Figure 9C
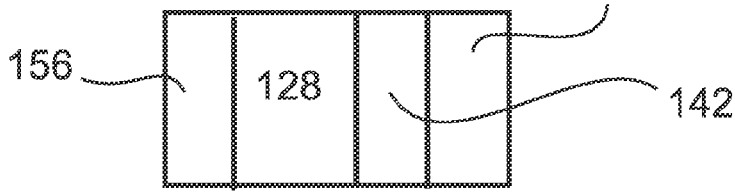
Figure 9B Figure 11
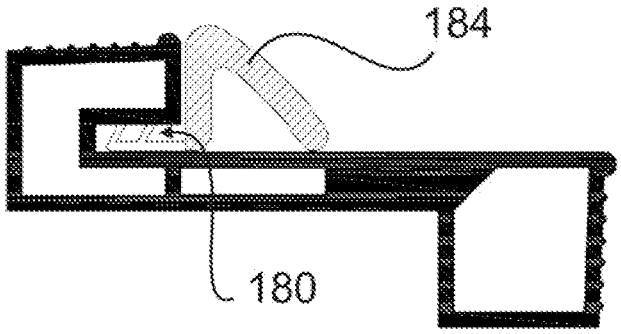
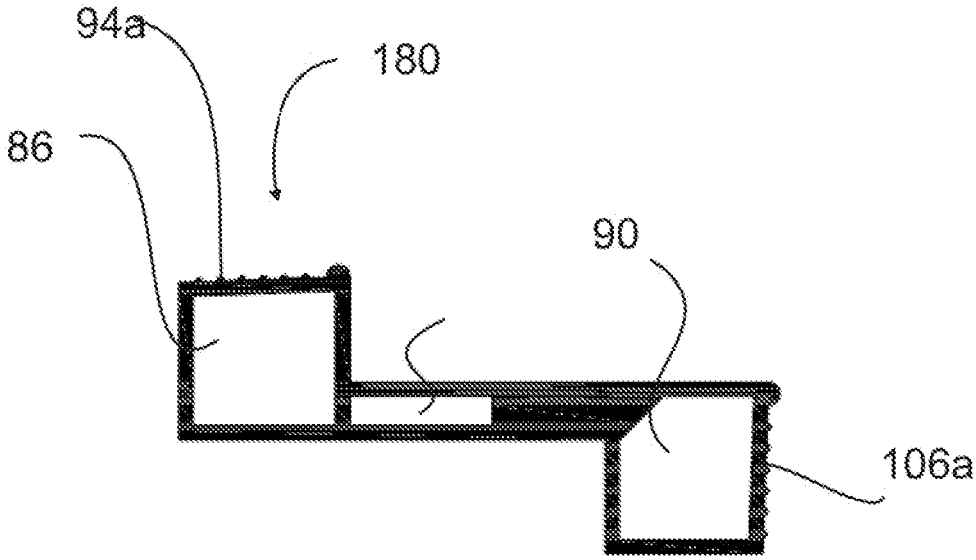
Figure 10

FLUSH JAMB

BACKGROUND OF THE INVENTION

Field of the Invention

The present invention relates to the field of construction and more particularly to the field of door jamb molding.

Description of the Related Art

Door jamb molding usually protrudes away from the wall. One purpose is to hide the cut edge of the wallboard. A number of patents and patent publications cover molding of various types.

U.S. Pat. No. 6,859,977

This Patent is directed to a security storm door having a jamb that may be made of a number of high strength materials including aluminum. The lock jamb is generally Z-shaped having a flange that extends outwardly with an outwardly facing front surface on the outer flange and has an outwardly facing rear surface on the inner flange. A lock jamb includes a jamb body.

U.S. Pre-Grant Publication 200910235608

This reference is directed to a support structure for a variety of uses that with the structure typically employing a plurality of triangular-shaped elements that form a low-profile structural support member that may be formed from sheet material such as aluminum using cold roll-forming or bending technology. Support structures are generally trapezoidal shaped formed by a pair of triangles. The support structures may for example be utilized in window and/or door jambs.

U.S. Pat. No. 5,230,180

This Patent is directed to a door assembly having hidden screw construction including the side jambs and header of the door opening. A door mounted in an opening is surrounded by a Z-bar header and a pair of spaced apart jamb Z-bars. Each has a back flange, middle flange and front flange. The front flanges are each provided with a vertically extending channel having a channel bottom wall that receives a plurality of screws that secure the Z-bars to the door opening jambs.

U.S. Pat. No. 6,408,922

This Patent is directed to a self-supporting construction frame for installation of doors and windows. The construction frame can be used for example, for the installation of in or out-swinging doors, screen doors, retractable screen doors, screens for windows, windows, and accordion doors. Construction frame may be mounted either on the inside of an existing doorway or on the outside of the doorway. A plurality of clips can be used to attach the jamb to the guiderails A jamb and jamb support can be used for construction of a face mounting frame. The jamb can be installed directly onto the door frame for inside door frame installations. The jamb can be directly fastened to the jamb support for door face installations. The jamb may include predrilled clearance holes for mounting and the jamb support has matching tapped holes to accept fastening screws from the jamb.

U.S. Pat. No. 6,993,875

This Patent is directed to building elements useful in construction. It shows the integration of wall panels with a door using a suitable decorative extrusion. The door is integrated with the wall system of the invention but includes an extrusion which carries a channel for a felt strip or other insulating strip. The extrusion is a door stop. The extrusion is mounted on a decorative extrusion which ends the wall system forming a door jamb. The door may be mounted between walls using the system of the invention. Felt is placed in the channel of the extrusion. The channel and the felt provide a rest stop for the door.

None of these inventions provides a door jamb that is flush with the wallboard. Further, none of these inventions provides a pocket into which the wallboard can fit.

Development of a door jamb which, when fastened in place, is flush with the wallboard represents a great improvement in the field of construction and satisfies a long felt need of architects and builders. Development of a door jamb which, when fastened in place, provides a pocket into which the wallboard fits represents a great improvement in the field of construction and satisfies a long felt need of architects and builders.

SUMMARY OF THE INVENTION

The present invention is a door jamb which, when fastened in place, is flush with the wallboard. This invention is also a door jamb which, when fastened in place, provides a pocket into which the wallboard fits The preferred embodiment of this invention comprises a central web having a first surface a second surface, a first side and a second side, with a first right triangular section at the first side and a second right triangular section at the second side. The adjacent leg of the first right triangular section is in line with the second surface and the opposite leg of the first right triangular section projects away from the first surface. Further the adjacent leg of the second right triangular section is in line with the first surface and the opposite leg of the second right triangular section projects away from the second surface.

A first alternate embodiment comprises a central web having a first surface a second surface, a first side and a second side with a first rectangular section at the first side and a second rectangular section at the second side. One side of the first rectangular section is in line with the second surface and the perpendicular side of the first rectangular section projects away from the first surface. Further one side of the second rectangular section is in line with the first surface and the perpendicular side of the second rectangular section projects away from the second surface.

A second alternate embodiment comprises a central web having a first surface, a second surface, a first side and a second side. There is a first rectangular section at the first side, which has a first side, a perpendicular side, and an opposite side. The first side and perpendicular side are at right angles to each other and the first side and the opposite side are parallel to each other.

There is a second rectangular section at the second side which has a first side, a perpendicular side and an opposite side. The first side and perpendicular side are at right angles to each other and the perpendicular side and the opposite side are parallel to each other. The first side of the first rectangular section is in line with the second surface and the perpendicular side of the first rectangular section projects away from the first surface. The first side of the second rectangular section is in line with the first surface and the perpendicular side of the second rectangular section projects away from the second surface.

There is a third rectangular section at the opposite side of the first rectangular section, which has a first side and a perpendicular side, perpendicular to each other. The perpendicular side of the third rectangular section is longer than the opposite side of the second rectangular section. The first side of the third rectangular section is in line with the perpendicular side of the first rectangular section and the perpendicular side of the third rectangular section is parallel to the opposite side of the first rectangular section.

There is a fourth rectangular section at the opposite side of the second rectangular section, which has a first side and a perpendicular side, perpendicular to each other. The perpendicular side of the fourth rectangular section is longer than the opposite side of the second rectangular section. The first side of the fourth rectangular section is in line with the first side of the second rectangular section and the perpendicular side of the fourth rectangular section is parallel to the opposite side of the second rectangular section.

The jamb is perceived as part of the wall, rather than part of the door. In other words the door jamb disappears. This invention works on all framing sizes—2"×4" wall as well as 2"×8". You do not need to have different size jambs for different size walls. This invention yields streamlined, modern look.

The preferred and first alternate moldings can be used to construct a door frame in a door opening. The molding is cut to size and fastened to the framing, with the corner guide against the framing corner. Wallboard is cut as accurately as possible to match the fastened jamb molding and fastened to the framing. Any spaces between the wallboard and molding are patched with spackle.

The second alternate molding can be used to construct a door frame in a door opening. The molding is cut to size and fastened to the framing, which creates a slot between the framing and the molding. Wallboard is cut to match the molding, slid into the pocket and then fastened to the framing. No patching is necessary. The projection can be shaped to variety of decorative and expressive shapes.

An appreciation of the other aims and objectives of the present invention and an understanding of it may be achieved by referring to the accompanying drawings and description of a preferred embodiment.

BRIEF DESCRIPTION OF THE DRAWINGS

FIG. 2 is a view of a small segment of the preferred embodiment from one end, the view from the other end being identical.

FIG. 2A is a view of a small segment of the preferred embodiment looking at one surface and one hypotenuse.

FIG. 2B is a view of a small segment of the preferred embodiment looking at the other hypotenuse and one opposite.

FIG. 2C is a view of a small segment of the preferred embodiment looking the other surface and the other hypotenuse.

FIG. 2D is a view of a small segment of the preferred embodiment looking at one hypotenuse and the other opposite.

FIG. 7 is a view of a small segment of this alternate embodiment from one end, the view from the other end being identical.

FIG. 7A is a view of a small segment of this alternate embodiment from one side.

FIG. 7B is a view of a small segment of this alternate embodiment from the top.

FIG. 7C is a view of a small segment of this alternate embodiment from the other side.

FIG. 7D is a view of a small segment of this alternate embodiment from the bottom.

FIG. 9 is a view of a small segment of this alternate embodiment from one end, the view from the other end being identical.

FIG. 9A is a view of a small segment of this alternate embodiment from one side.

FIG. 9B is a view of a small segment of this alternate embodiment from the top.

FIG. 9C is a view of a small segment of this alternate embodiment from the other side.

FIG. 9D is a view of a small segment of this alternate embodiment from the bottom.

FIG. 10 shows some variations of this invention illustrated with the alternate embodiment.

FIG. 11 shows some other variations of this invention illustrated with the alternate embodiment.

DETAILED DESCRIPTION OF THE PREFERRED EMBODIMENT

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Figure 1:
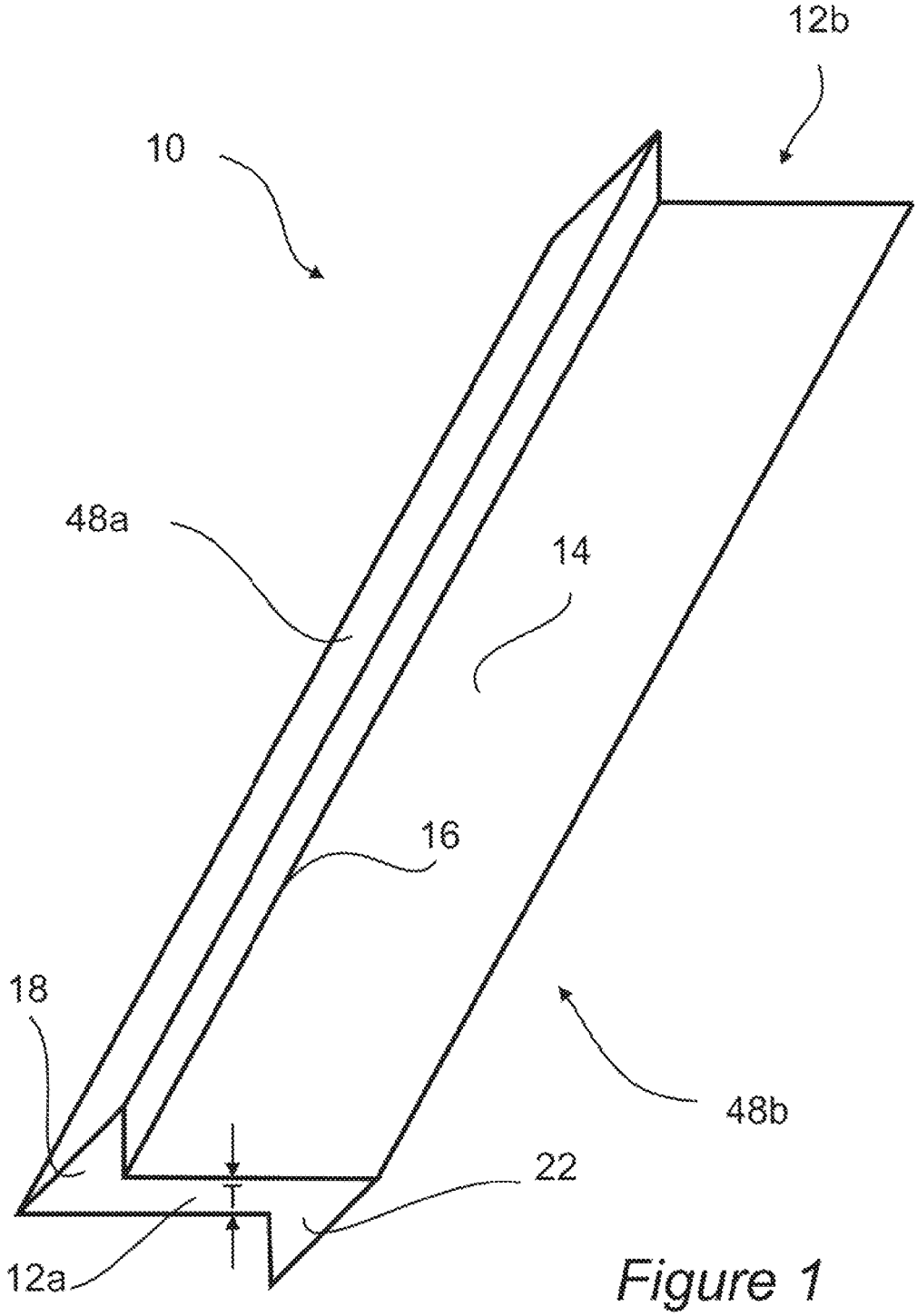
FIG. 1 is an isometric view of the preferred embodiment of this invention.
Figure 4:
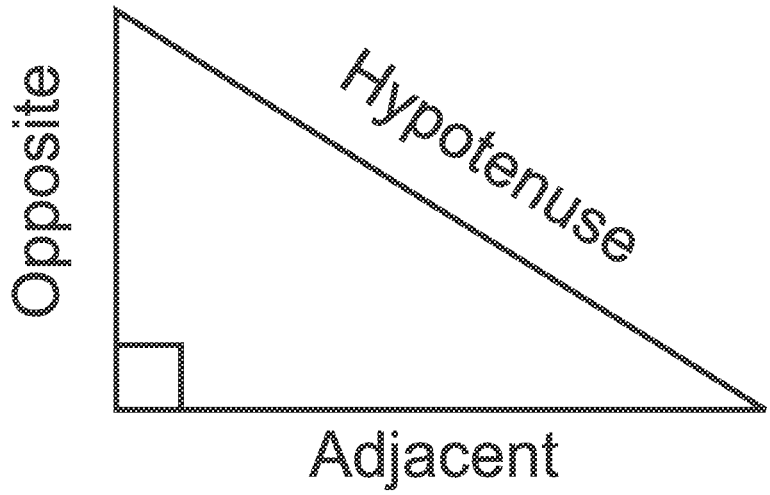
FIG. 4 illustrates the naming conventions for the sides of a right triangle.
Figure 4A:
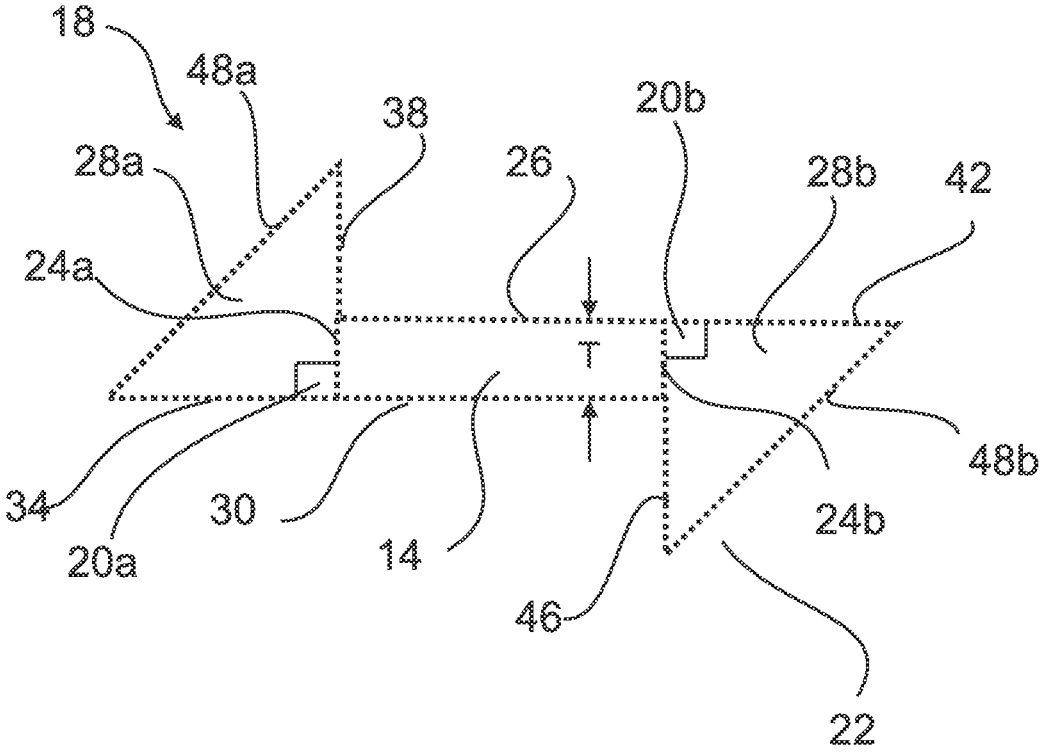
FIG. 4A illustrates one way of conceiving of the preferred embodiment of this invention.

FIG. 1 is an isometric view of the preferred embodiment 10 of this invention, which will be provided in discrete lengths and thus has ends 12*a*, 12*b*. FIG. 4 illustrates the naming conventions for the sides of a right triangle. This embodiment 10 may be thought of as a central web 14 with first and second right triangles 18, 22 at first and second sides 24*a*, 24*b*. See FIG. 4A. The central web 14 has a first 26 surface and a second surface 30. Each right triangle 18, 22 has an adjacent leg 34, 42 and an opposite leg 38, 46. The adjacent leg 34 of first triangle 18 is in line with the first surface 26 while the adjacent leg 42 of the second triangle 22 is in line with the second surface 30. The opposite leg 38 of first triangle 18 projects at right angles to the first surface 26 and the opposite leg 46 of the second triangle 22 projects at right angles from the second surface 30. The lengths of the opposite legs 38, 46 are greater than the thickness T of the web 14. Also the lengths L of the opposite 38 and adjacent 42 legs are the same thickness W as the wallboard. The corner 16 is used as a guide as will become apparent from subsequent description.

FIG. 2 is a view of a small segment of the preferred embodiment 10 from one end, 12*a* the view from the other end 12*b* being a mirror image. FIG. 2A is a view of a small segment of the preferred embodiment 10 looking at one surface 26 and one hypotenuse 48*a*. FIG. 2B is a view of a small segment of the preferred embodiment 10 looking at the other hypotenuse 48*b* and one opposite 38. FIG. 2C is a view of a small segment of the preferred embodiment 10 looking the other surface 30 and the other hypotenuse 48*b*. FIG. 2D is a view of a small segment of the preferred embodiment 10 looking at one hypotenuse 48*a* and the other opposite 46.

Figure 3:
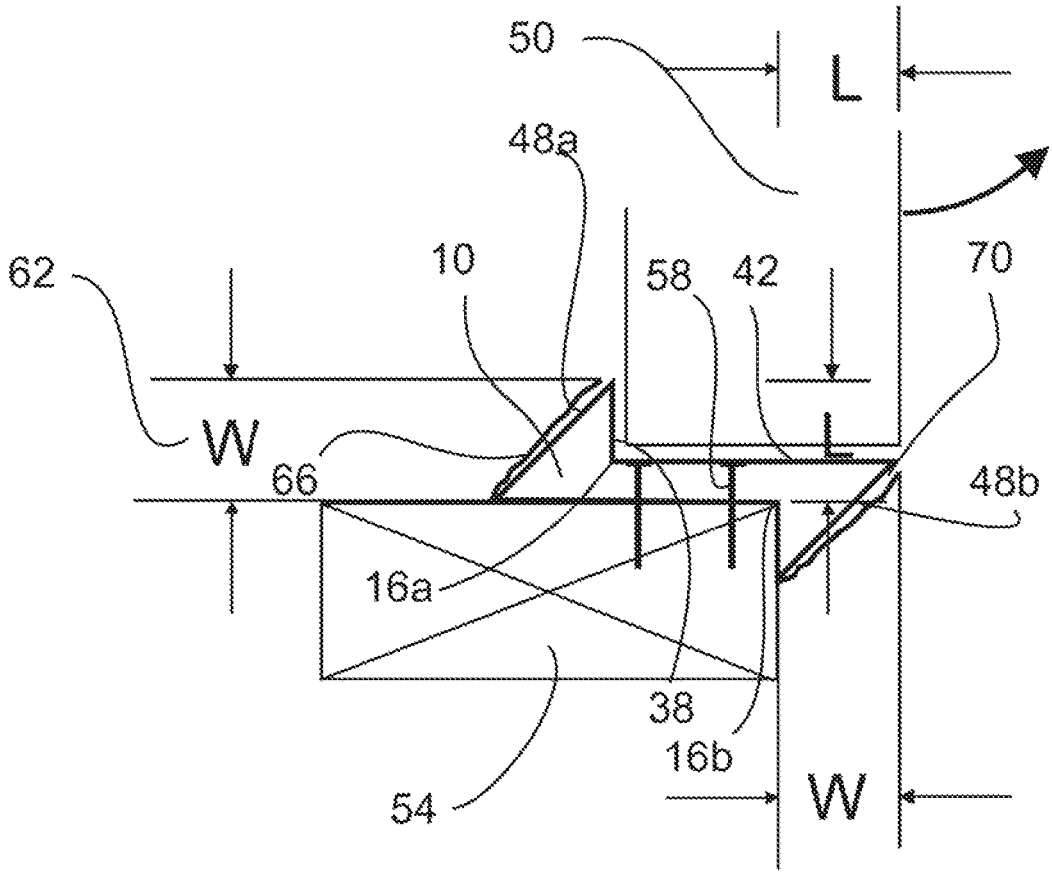
FIG. 3 is a horizontal cross section of the preferred embodiment installed in a doorway with the door in the closed position.

FIG. 3 is a partial horizontal cross section of the preferred embodiment 10 installed in a doorway with the door 50 in the closed position. The jamb 10 is fastened to a stud 54 preferably with nails 58 although other means of fastening could be used. One corner 16*b* is used to position the jamb 10 tight against the corner of the stud 54. The other corner 16*a* receives the corner of the door 50. Side 38 functions as a door stop.

Figure 3A:
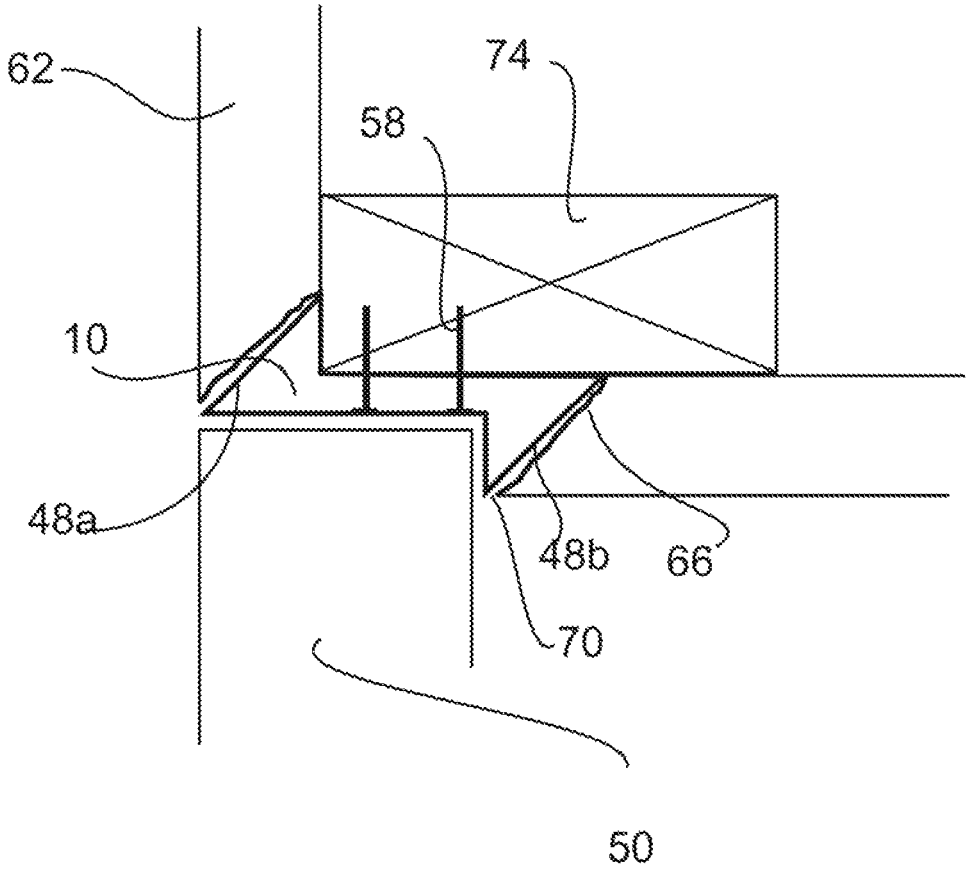
FIG. 3A is a vertical cross section of the preferred embodiment installed in a doorway with the door in the closed position.

FIG. 3A is a partial vertical cross section of the preferred embodiment 10 installed in a doorway with the door 50 in the closed position. The jamb 10 is fastened to a header 74 preferably with nails 58. Wallboard 62 is cut to fit around the doorway. The edge that will fit against the jamb 10 is cut at an angle matching the angle of the hypotenuses 48*a*, 48*b*. Since wallboard 62 is frangible, the cut surface 66 is typically rough and not at a perfect angle. Therefore, later on, spackle or equivalent is used to fill in the gaps 70.

Figure 5:
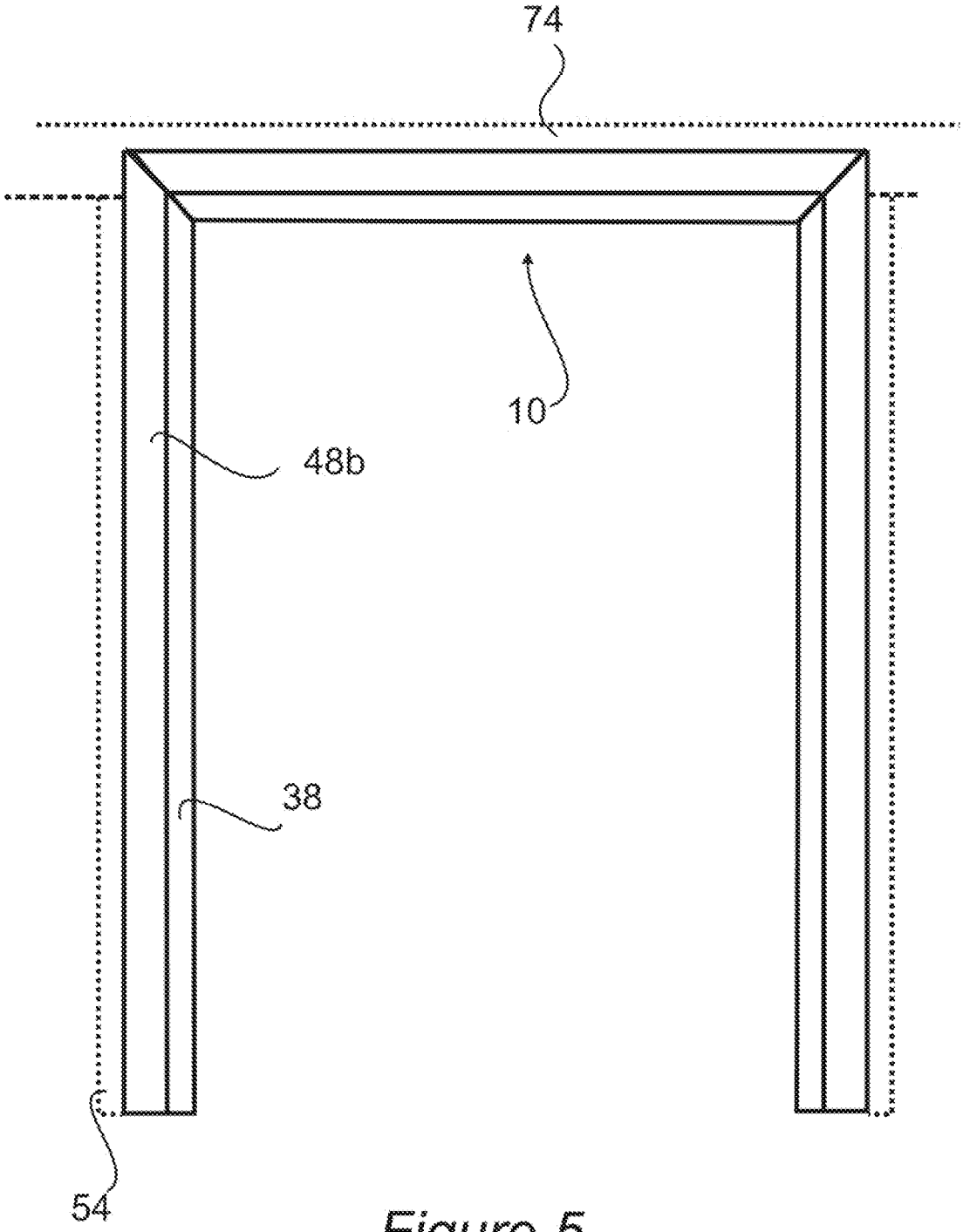
FIG. 5 is a front view showing the preferred embodiment of this invention installed in door framing.

FIG. 5 is a front view showing the preferred embodiment 10 of this invention installed in the stud 54 and header 74 of a door opening.

Figure 6A:
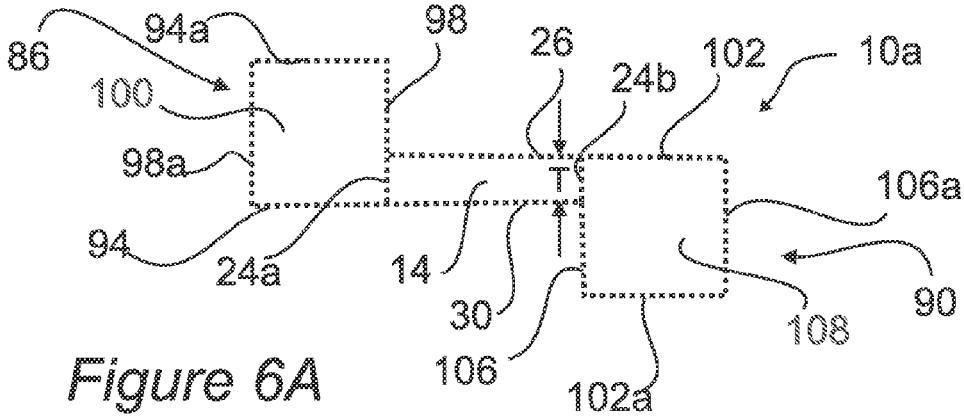
FIG. 6A illustrates one way of conceiving of an alternate embodiment of this invention.
Figure 6:
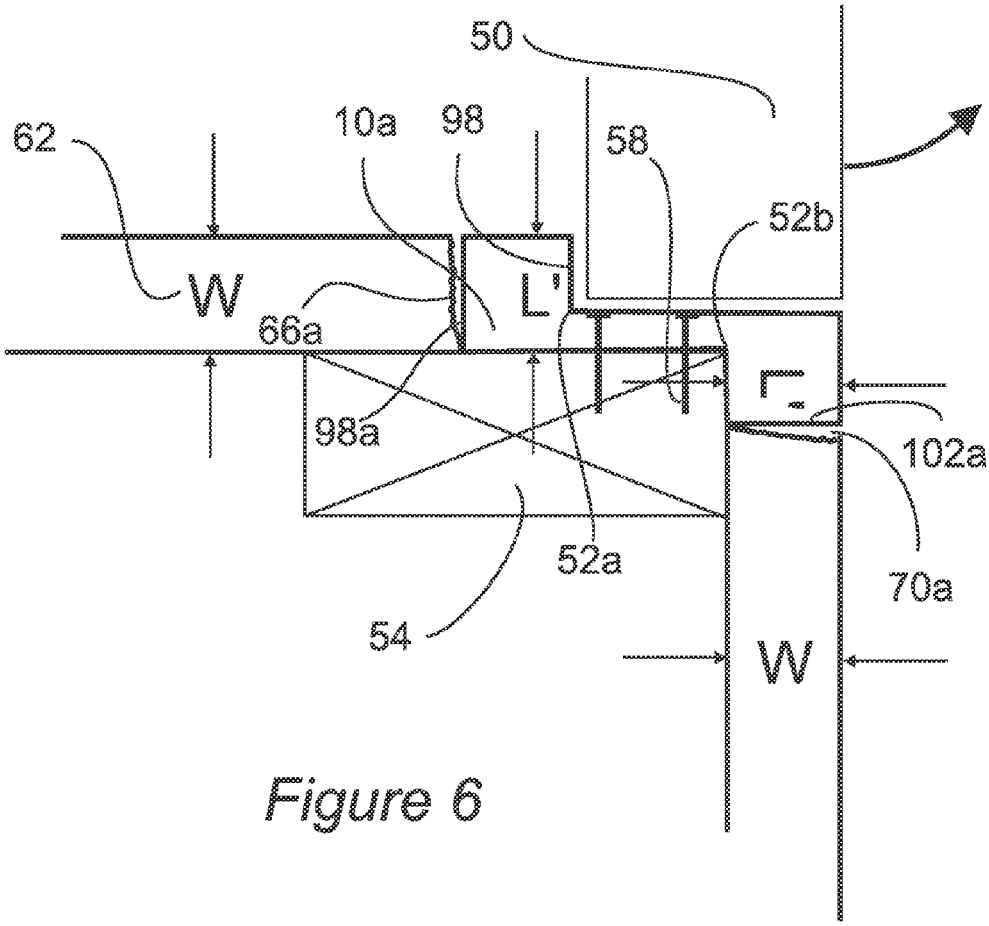
FIG. 6 is a horizontal cross section of an alternate embodiment of this invention installed in a doorway with the door in the closed position.

FIG. 6 is a horizontal cross section of an alternate embodiment 10*a* of this invention installed in a doorway with the door 50 in the closed position. The corner 52*b* is used to position the jamb 10*a* tightly against the corner of the stud 54. The other corner 52*a* receives the corner of the door 50. Side 98 functions as a door stop. The vertical cross section is analogous to this view in the same way that FIG. 3 is analogous to FIG. 3A.

FIG. 6A illustrates one way of conceiving of this alternate embodiment 10*a*. This embodiment 10*a* also has a central web 14 with a first surface 26 and a second surface 30. At each end 24*a*, 24*b* there is a rectangle 86, 90. The first side 94 of the first rectangle 86 is in line with the second surface 30 and the perpendicular side 98 of the first rectangle 86 projects away from the first surface 26. The first side 102 of the second rectangle 90 is in line with the first surface 26 and the perpendicular side 106 of the second rectangle 90 projects away from the second surface 30. The lengths of the sides 98, 106 are greater than the thickness T of the web 14. Also, the lengths L' of the perpendicular sides 98, 98*a* and in line sides 102, 102*a* sides are the same as the thickness W of the wallboard.

As illustrated in FIG. 6, wallboard 62 is cut to fit around the doorway. Since wallboard 62 is frangible, the cut edge 66*a* is typically rough and not at a perfect angle. Therefore, later on, spackle, with or without tape, or equivalent is used to fill in the gaps 70*a*. Tape can be extended to cover the other first side 94*a* or the other perpendicular side 106*a*.

FIG. 7 is a view of a small segment of this alternate embodiment 10*a* from one end 110, the view from the other end being identical. FIG. 7A is a view of a small segment of this alternate embodiment 10*a* looking at one surface 26 and the other perpendicular side 94*a* of the first rectangle 86. FIG. 7B is a view of a small segment of this alternate embodiment 10*a* looking at one perpendicular side 98 and the other perpendicular side 106*a* of the second rectangle 90. FIG. 7C is a view of a small segment of this alternate embodiment 10*a* looking at the other surface 30 and the other first side 102*a* of the second rectangle 90. FIG. 7D is a view of a small segment of this alternate embodiment 10*a* looking at the other perpendicular side 106 and the other perpendicular side 98*a* of the first rectangle 86.

Figure 8A:
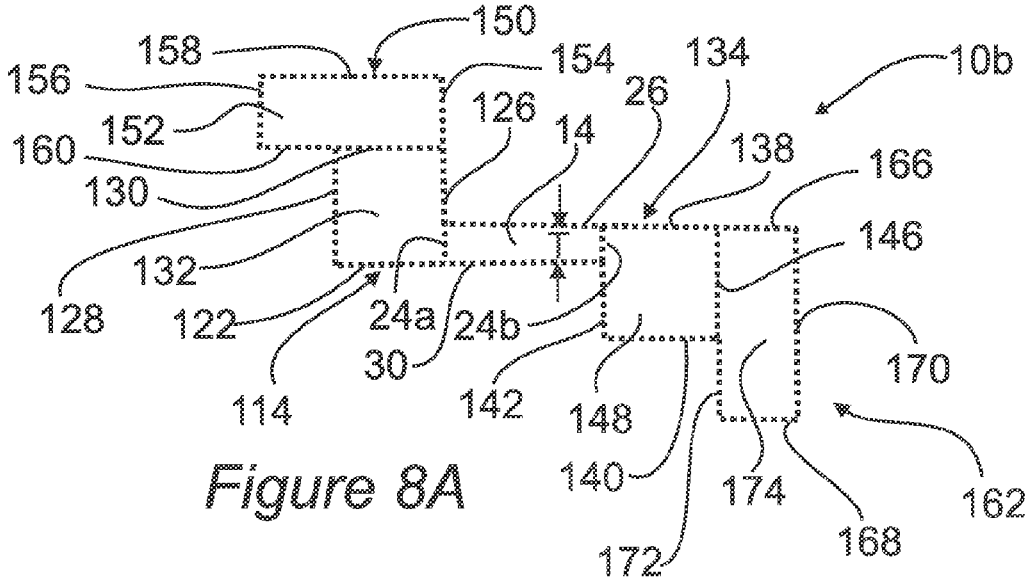
FIG. 8A illustrates one way of conceiving of the other alternate embodiment of this invention.
Figure 8:
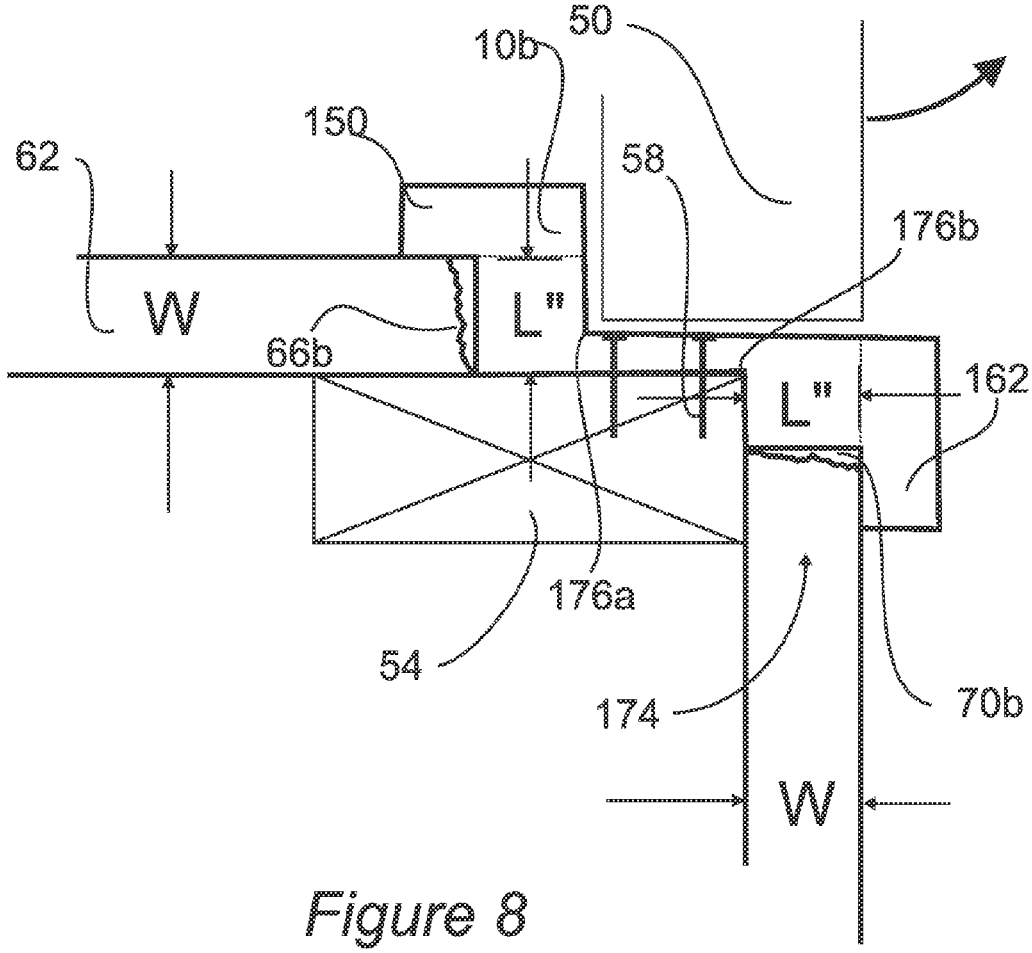
FIG. 8 is a horizontal cross section of another alternate embodiment of this invention installed in a doorway with the door in the closed position.

FIG. 8 is a horizontal cross section of another alternate embodiment 10*b* of this invention installed in a doorway with the door 50 in the closed position. The corner 176*b* is used to position the jamb 10*b* tightly against the corner of the stud 54. The other corner 176*a* receives the corner of the door 50. Sides 154 and 126 function as a door stop. The vertical cross section is analogous to this view in the same way that FIG. 3 is analogous to FIG. 3A.

FIG. 8A illustrates one way of conceiving of the other alternate embodiment 10*b* of this invention. This embodiment 10*b* also has a central web 14 with a first surface 26 and a second surface 30. There is a first rectangular section 114 at the first side 24*a*. The first rectangular section 114 has a first side 122, two perpendicular sides 126, 128 and an opposite side 130. The first side 122 and perpendicular sides 126, 128 are at right angles to each other and the first side 122 and the opposite side 130 are parallel to each other. The lengths of the sides 126, 142 are greater than the thickness T of the web 14. The lengths L" of sides 128, 126, 138 and 140 are the same as the thickness W of the wallboard There is a second rectangular section 134 at the second side 24*b*. The second rectangular section 134 has two first sides 138, 140 a perpendicular side 142 and an opposite side 146. The first sides 138, 140 and perpendicular side 142 are at right angles to each other and the perpendicular side 142 and the opposite side 146 are parallel to each other.

The first side 122 of the first rectangular section 114 is in line with the second surface 30 and the perpendicular side 126 of the first rectangular section 114 projects away from the first surface 26.

The first side 138 of the second rectangular 134 section is in line with the first surface 26 and the perpendicular side 142 of the second rectangular section 134 projects away from the second surface 30.

There is a third rectangular section 150 at the opposite side 130 of the first rectangular section 114. The third rectangular section 150 has two first sides 154, 156 and two perpendicular sides 158, 160 perpendicular to each other. The perpendicular sides 158, 160 of the third rectangular section 150 are longer than the opposite side 130 of the second rectangular section 114. The first side 154 of the third rectangular section 150 is in line with the perpendicular side 126 of the first rectangular section 114 and the perpendicular sides 158, 160 of the third rectangular section are parallel to the opposite 130 side of the first rectangular section 114.

There is a fourth rectangular section 162 at the opposite side 146 of the second rectangular 134 section. The fourth rectangular section 162 has two first sides 166, 168 and two perpendicular sides 170, 172 perpendicular to each other. The perpendicular sides 170, 172 of the fourth rectangular section 162 are longer than the opposite side 146 of the second rectangular section 134. The first side 166 of the fourth rectangular section 162 is in line with the first side 138 of the second rectangular section 134 and the sides 170, 172 of the fourth rectangular section 162 are parallel to the opposite side 146 of the fourth rectangular section 162.

Wallboard 62 is cut to fit around the doorway. Since wallboard 62 is frangible, the cut edge 66*b* is typically rough and not at a perfect angle. However, the cut edge 66*b* slides in to pockets 174 that are formed between the third 150 and fourth 162 rectangular sections and the stud 54. In this way any gaps 70*b* are hidden from view.

FIG. 9 is a view of a small segment of this alternate embodiment 10*b* from one end 174, the view from the other end being the mirror image. FIG. 9A is a view of a small segment of this alternate embodiment 10*b* looking at surfaces 168, 140, 30, 122 and 160. FIG. 9B is a view of a small segment of this alternate embodiment 10*b* looking at surface 156, 128, 142 and 172. FIG. 9C is a view of a small segment of this alternate embodiment 10*b* looking at surfaces 158, 26, 138 and 166. FIG. 9D is a view of a small segment of this alternate embodiment 10*b* looking at surfaces 154, 126 and 170.

FIG. 10 shows some variations of this invention illustrated with the alternate embodiment 10*a*. In this embodiment the web 14 and rectangles 86, 90 are hollow and three dimensional decoration 180 is applied to sides 94*a* and 106*a* FIG. 11 shows further variations of this invention illustrated with the alternate embodiment 10*a*. In this embodiment there is a kerf 180 in one of the rectangles 86 into which a gasket or seal 184 is fastened. This gasket or seal 184 is intended to absorb the impact from closing of the door 50 and provide an air tight seal between the door 50 and the jamb 10.

Those that are familiar with the art to which this invention applies will recognize certain symmetrical features of this invention. Further they will recognize that shapes other than rectangles, triangles and squares could be utilized in this invention.

Other shapes that would work with this invention would be parallelograms, circles, ovals, hexagons, octagons, etc. and their combinations.

The following reference numerals are used on FIGS. 1 through 11:

10 preferred embodiment
10*a* first alternate embodiment
10*c* second alternate embodiment
12*a* one end of preferred embodiment
12*b* other end of preferred embodiment
14 central web
16 corner
16*a* door receiving corner
16*b* corner guide
18 first right triangle
20*a* right angle of first right triangle
20*b* right angle of second right triangle
22 second right triangle
24*a* first side of central web
24*b* second side of central web
26 first surface of central web
28*a* one end of first triangle
28*b* one end of second triangle
30 second surface of central web
32*a* other end of first triangle
32*b* other end of first triangle
34 adjacent side of first right triangle
38 opposite side of first right triangle
42 adjacent side of second right triangle
46 opposite side of second right triangle
48*a* hypotenuse of first right triangle
48*b* hypotenuse of second right triangle
50 door
52*a* door receiving corner
52*b* corner guide
54 stud
58 nail
62 wallboard
66 cut surface
66*a* cut edge
70 gap
70*a* gap
74 header
86 first rectangle of first alternate embodiment
90 second rectangle of first alternate embodiment
94 first side of first rectangle of first alternate embodiment
94*a* other first side of first rectangle of first alternate embodiment
98 perpendicular side of first rectangle of first alternate embodiment
98*a* other perpendicular side of first rectangle of first alternate embodiment
100 one end of first rectangle of first alternate embodiment
100*a* other end of first rectangle of first alternate embodiment
102 first side of second rectangle of first alternate embodiment
102*a* other first side of second rectangle of first alternate embodiment
106 perpendicular side of second rectangle of first alternate embodiment
106*a* other perpendicular side of second rectangle of first alternate embodiment
108 one end of second rectangle of first alternate embodiment
108*a* other end of second rectangle of first alternate embodiment
114 first rectangular section of second alternate embodiment
122 first side of first rectangular section of second alternate embodiment
126 perpendicular side of first rectangular section of second alternate embodiment
128 other perpendicular side of first rectangular section of second alternate embodiment
130 opposite side of first rectangular section of second alternate embodiment
132 one end of first rectangle of second alternate embodiment
132*a* other end of first rectangle of second alternate embodiment
134 second rectangular section of second alternate embodiment
138 first side of second rectangular section of second alternate embodiment
140 other first side of second rectangular section of second alternate embodiment
142 perpendicular side of second rectangular section of second alternate embodiment
146 opposite side of second rectangular section of second alternate embodiment
148 one end of second rectangle of second alternate embodiment
148*a* other end of second rectangle of second alternate embodiment
150 third rectangular section of second alternate embodiment
152 one end of third rectangle of second alternate embodiment
152*a* other end of third rectangle of second alternate embodiment

154 first side of third rectangular section of second alternate embodiment

156 other first side of third rectangular section of second alternate embodiment

158 perpendicular side of third rectangular section of second alternate embodiment

160 other perpendicular side of third rectangular section of second alternate embodiment

162 fourth rectangular section of second alternate embodiment

166 first side of fourth rectangular section of second alternate embodiment

168 other first side of fourth rectangular section of second alternate embodiment

170 perpendicular side of fourth rectangular section of second alternate embodiment

172 other perpendicular side of fourth rectangular section of second alternate embodiment

174 one end of fourth rectangle of second alternate embodiment

174 other end of fourth rectangle of second alternate embodiment

176*a* door receiving corner

176*b* corner guide

180 kerf

184 gasket

L length of sides 38 and 42

L' length of sides 98, 98*a*, 102 and 102*a*

L" length of sides 128, 126, 138 and 140

T thickness of web

W thickness of wallboard

Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

What is claimed is:

1. An elongated structure comprising:

a) a central web having a first web surface, a second web surface, a first virtual side, a second virtual side, a first web end and a second web end; said first and second web ends being parallel to each other and spaced apart a distance; said first and second web surfaces being parallel to each other and spaced apart a second distance; said first and second virtual sides being parallel to each other and spaced apart a third distance; said first web surface meeting said first and second virtual sides at right angles; said second web surface meeting said first and second virtual sides at right angles; said first and second web ends meeting said first and second web surfaces and said first and second virtual sides at right angles;

b) a first right triangular section at said first virtual side; said first right triangular section having a first right angle, a first adjacent side, a first opposite side, a first right triangular section first end and a first right triangular section second end; said first adjacent side and said first opposite side meeting at said first right angle; said first right triangular section first and second ends being parallel to each other and spaced apart by said distance; and c) a second right triangular section at said second virtual side; said second right triangular section having a second right angle, a second adjacent side, a second opposite side, a second right triangular section first end and a second right triangular section second end; said second adjacent side meeting said second opposite side at said second right angle; said second right triangular section first and second ends being parallel to each other and spaced apart by said distance;

said first adjacent side being in line with said second web surface; said first right angle being at a junction of said first adjacent side and said second web surface; said first opposite side projecting away from said first web surface;

said second adjacent side being in line with said first web surface; said second right angle being at a junction of said adjacent side of said second adjacent side and said first web surface; said second opposite side projecting away from said web second surface in substantially the opposite direction as said first opposite side;

said web surfaces and said ends being planar; all of said first ends being coplanar; all of said second ends being coplanar.

2. An elongated structure as claimed in claim 1 further comprising a stud and a header assembled to form a door opening; said elongated structure fastened to said stud and header whereby a door frame is created.

3. An elongated structure as claimed in claim 2 further comprising wallboard fitted to said elongated structure and fastened to said stud and header.

4. An elongated structure as claimed in claim 1 in which at least one of said first and second right triangular sections is hollow.

5. An elongated structure as claimed in claim 1 in which said central web is hollow.

6. An elongated structure as claimed in claim 1 in which one of said first and second right triangular sections has a kerf intersecting its opposite side and further comprising a seal affixed in said kerf.

7. An elongated structure as claimed in claim 1 further comprising a three dimensional decoration on a hypotenuse of at least one of said first and second right triangular sections.

8. An elongated structure comprising:

a) a central web having a first web surface, a second web surface, a first virtual side, a second virtual side, a first web end and a second web end; said first and second web ends being parallel to each other and spaced apart a distance; said first and second web surfaces being parallel to each other and spaced apart a second distance; said first and second virtual sides being parallel to each other and spaced apart a third distance; said first web surface meeting said first and second virtual sides at right angles; said second web surface meeting said first and second virtual sides at right angles; said first and second web ends meeting said first and second web surfaces and said first and second virtual sides at right angles;

b) a first rectangular section, having two first rectangular section first sides, two first rectangular section second sides, a first rectangular section first end and a first rectangular section second end at said first virtual side; said first rectangular section first sides being perpendicular to said first rectangular section second sides; said first rectangular section ends being at right angles to said first rectangular section first and second sides; said first rectangular section first sides being parallel to each other and spaced apart by a fourth distance; said first rectangular section second sides being parallel to each other and spaced apart by a fifth distance; and c) a second rectangular section, having two second rectangular section first sides, two second rectangular section second sides, a second rectangular section first end, and a second rectangular section second end at said second virtual side; said second rectangular section first sides being perpendicular to said second rectangular section second sides; said second rectangular section ends being at right angles to said second rectangular section first and second sides; said second rectangular section first sides being parallel to each other and spaced apart by a sixth distance; said second rectangular section second sides being parallel to each other and spaced apart by a seventh distance;

one of said first rectangular section first sides being in line with said second web surface; said first rectangular section second sides projecting away from said first and second web surfaces in a direction from said second web surface to said first web surface;

one of said second rectangular section first sides being in line with said first web surface; said second rectangular section second sides projecting away from said first and second web surfaces in a direction from said first web surface to said second web surface;

said web surfaces and said rectangular section ends being planar; said first web end and said first and second rectangular section first ends being coplanar; said second web end and said first and second rectangular section second ends being coplanar.

9. An elongated structure as claimed in claim 8 further comprising a stud and a header assembled to form a door opening; said elongated structure fastened to said stud and header whereby a door frame is created.

10. An elongated structure as claimed in claim 9 further comprising wallboard fitted to said elongated structure and fastened to said stud and header.

11. An elongated structure as claimed in claim 8 in which at least one of said first and second rectangular sections is hollow.

12. An elongated structure as claimed in claim 8 in which said central web is hollow.

13. An elongated structure as claimed in claim 8 in which said one of said first and second rectangular sections has a kerf intersecting its first side and further comprising a seal affixed in said kerf.

14. An elongated structure as claimed in claim 8 further comprising a three dimensional decoration on one of said first rectangular section first sides.

15. An elongated structure as claimed in claim 8 further comprising a three dimensional decoration on one of said second rectangular section first sides.

16. An elongated structure comprising:

a) a central web having a first web surface a second web surface, a first virtual side, a second virtual side, a first web end and a second web end; said first and second web ends being parallel to each other and spaced apart a distance; said first and second web surfaces being parallel to each other and spaced apart a second distance; said first and second virtual sides being parallel to each other and spaced apart a third distance; said first web surface meeting said first and second virtual sides at right angles; said second web surface meeting said first and second virtual sides at right angles; said first and second web ends meeting said first and second web surfaces and said first and second virtual sides at right angles;

b) a first rectangular section, having two first rectangular section first sides, two first rectangular section second sides and two first rectangular section ends at said first virtual side; said first rectangular section first sides being perpendicular to said first rectangular section second sides; said first rectangular section ends being at right angles to said first rectangular section first and second sides; said first rectangular section first sides being parallel to each other and spaced apart by a fourth distance; said first rectangular section second sides being parallel to each other and spaced apart by a fifth distance; and c) a second rectangular section, having two second rectangular section first sides, two second rectangular section second sides and two second rectangular section ends at said second virtual side; said second rectangular section first sides being perpendicular to said second rectangular section second sides; said second rectangular section ends being at right angles to said second rectangular section first and second sides; said second rectangular section second sides being parallel to each other and spaced apart by a sixth distance; said second rectangular section second sides being parallel to each other and spaced apart by a seventh distance;

one of said first rectangular section first sides being in line with said second web surface; said first rectangular section second sides projecting away from said second first and second web surfaces in a direction from said second web surface to said first web surface;

one of said second rectangular section first sides being in line with said first web surface; said second rectangular section second sides projecting away from said first and second web surfaces in a direction from said first web surface to said second web surface;

d) a third rectangular section, having two third rectangular section first sides, two third rectangular section second sides and two third rectangular section ends adjacent to said first rectangular section; said third rectangular section first sides being perpendicular to said third rectangular section second sides; said third rectangular section ends being at right angles to said third rectangular section first and second sides; said third rectangular section first sides being parallel to each other and spaced apart by an eighth distance; said third rectangular section second sides being parallel to each other and spaced apart by a ninth distance; one of said third rectangular section first sides being in line with one of said first rectangular second sides; said third rectangular section second sides projecting away from said first virtual side towards the other of said second sides of said first rectangular section; and e) a fourth rectangular section, having two fourth rectangular section first sides, two fourth rectangular section second sides and two fourth rectangular section ends adjacent to said second rectangular section; said fourth rectangular section first sides being perpendicular to said fourth rectangular section second sides; said fourth rectangular section ends being at right angles to said fourth rectangular section first and second sides; said fourth rectangular section first sides being parallel to each other and spaced apart by a tenth distance; said fourth rectangular section second sides being parallel to each other and spaced apart by an eleventh distance; one of said fourth rectangular section first sides being in line with one of said second rectangular section first sides; said fourth rectangular section second sides projecting away from said second rectangular section first side towards said second rectangular section first side;

all of said surfaces, ends and sides being planar; all of said first ends being coplanar; and all of said second ends being coplanar.

17. An elongated structure as claimed in claim 16 further comprising a stud and a header assembled to form a door opening; said elongated structure fastened to said stud and header whereby a door frame is created.

18. An elongated structure as claimed in claim 17 further comprising wallboard fitted to said elongated structure and fastened to said stud and header.

19. An elongated structure as claimed in claim 16 in which at least one of said rectangular sections is hollow.

20. An elongated structure as claimed in claim 16 in which said central web is hollow.

21. An elongated structure as claimed in claim 16 in which one of said rectangular sections has a kerf intersecting one of its sides and further comprising a seal affixed in said kerf.

22. An elongated structure as claimed in claim 16 further comprising a three dimensional decoration on one of said first sides.

23. An elongated structure as claimed in claim 16 further comprising a three dimensional decoration on one of said second sides.

24. An elongated structure as claimed in claim 16 in which said third rectangular section second sides are longer than said third rectangular section first sides.

25. An elongated structure as claimed in claim 16 in which said fourth rectangular section second sides are longer than said fourth rectangular section first sides.

26. An elongated structure comprising:

a) a central web having a first web surface, a second web surface, a first web side, a second web side, a first web end, and a second web end; said web ends being parallel to each other and spaced apart by a distance; said web surfaces being parallel to each other and spaced apart by a second distance; said web sides being parallel to each other and spaced apart by a third distance; said web ends meeting said web surfaces and said web sides at right angles;

b) a first regularly shaped section at said first side; said first regularly shaped section having a first section first end, a first section second end and a first section side; said first section ends being at right angles to said first section side; said first section ends being parallel to and spaced apart from each other by said distance; said first section side projecting from said first web surface in a direction towards said second web surface; and c) a second regularly shaped section at said second side; said second regularly shaped section having a second section first end, a second section second end and a second section side; said second section ends being at right angles to said second section side; said second section side projecting from said second web surface in a direction towards said first web surface.

27. An elongated structure as claimed in claim 26 further comprising a stud and a header assembled to form a door opening; said elongated structure fastened to said stud and header whereby a door frame is created.

28. An elongated structure as claimed in claim 27 further comprising wallboard fitted to said elongated structure and fastened to said stud and header.

29. An elongated structure as claimed in claim 26 in which at least one of said shaped sections is hollow.

30. An elongated structure as claimed in claim 26 in which said central web is hollow.

31. An elongated structure as claimed in claim 26 further comprising a seal affixed to one of said shaped sections, said seal affixed to provide a door seal.

32. An elongated structure as claimed in claim 26 further comprising a three dimensional decoration on at least one of said sides.

* * * * *